US009127217B2

(12) United States Patent
Lopez et al.

(10) Patent No.: US 9,127,217 B2
(45) **Date of Patent: *Sep. 8, 2015**

(54) METHOD OF MAKING HIGH ENERGY DISTILLATE FUELS

(75) Inventors: Jaime Lopez, Benicia, CA (US); Janine Lichtenberger, Berkeley, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 675 days.

This patent is subject to a terminal disclaimer.

(21) Appl. No.: 12/338,388

(22) Filed: Dec. 18, 2008

(65) Prior Publication Data

US 2009/0159489 A1 Jun. 25, 2009

Related U.S. Application Data

(60) Provisional application No. 61/016,095, filed on Dec. 21, 2007.

(51) Int. Cl.

| | |
|---|---|
| ***C10G 65/12*** | (2006.01) |
| ***C10G 65/08*** | (2006.01) |
| ***C10G 65/04*** | (2006.01) |
| ***C10G 45/50*** | (2006.01) |
| ***C10G 47/20*** | (2006.01) |

(52) U.S. Cl.

CPC ..... *C10G 65/12* (2013.01); *C10G 45/50* (2013.01); *C10G 47/20* (2013.01); *C10G 65/043* (2013.01); *C10G 65/08* (2013.01); *C10G 2300/1048* (2013.01); *C10G 2300/1096* (2013.01); *C10G 2300/202* (2013.01); *C10G 2300/308* (2013.01); *C10G 2400/04* (2013.01); *C10G 2400/08* (2013.01)

(58) Field of Classification Search

CPC ..... C10G 45/02; C10G 47/20; C10G 65/043; C10G 65/08; C10G 65/12

USPC ..... 208/15, 58, 60, 89

See application file for complete search history.

(56) References Cited

U.S. PATENT DOCUMENTS 3,012,961 A * 12/1961 Weisz ..... 208/66
3,130,007 A 4/1964 Breck (Continued)

FOREIGN PATENT DOCUMENTS

EP 189648 6/1986
JP 58168688 10/1983

(Continued)

*Primary Examiner* — Renee E Robinson

(74) *Attorney, Agent, or Firm* — M. Carmen & Associates, PLLC; Josetta I. Jones, Esq.

(57) ABSTRACT

A process of upgrading a highly aromatic hydrocarbon feedstream comprising (a) contacting a highly aromatic hydrocarbon feedstream, having a normal paraffin content of greater than at least about 5 wt %, wherein a major portion of the feedstream has a boiling range of from about 300° F. to about 800° F. under catalytic conditions with a catalyst system, containing a hydrotreating catalyst, a hydrogenation/hydrocracking catalyst, and a dewaxing catalyst in a single stage reactor system, wherein the active metals in the hydrogenation/hydrocracking catalyst comprises from about 5%-30% by weight of nickel and from about 5%-30% by weight tungsten; and (b) wherein at least a portion of the highly aromatic hydrocarbon feedstream is converted to a product stream having a boiling range within jet or diesel boiling ranges.

9 Claims, 2 Drawing Sheets

Novel Single Stage Process with High Activity Base Metal Catalysts

(56) References Cited

U.S. PATENT DOCUMENTS

| | | | | | |
|---|---|---|---|---|---|
| 3,222,274 | A | | 12/1965 | Carl et al. | |
| 3,536,605 | A | | 10/1970 | Kittrell | |
| 3,702,886 | A | | 11/1972 | Argauer et al. | |
| 3,770,614 | A | | 11/1973 | Graven | |
| 3,808,326 | A | | 4/1974 | McDaniel et al. | |
| 3,835,027 | A | | 9/1974 | Ward | |
| 3,923,638 | A | * | 12/1975 | Bertolacini et al. | 208/89 |
| 4,162,961 | A | | 7/1979 | Marmo | |
| 4,202,758 | A | | 5/1980 | Ohara et al. | |
| 4,427,534 | A | * | 1/1984 | Brunn et al. | 208/89 |
| 4,619,759 | A | | 10/1986 | Myers et al. | |
| 4,968,402 | A | | 11/1990 | Kirker et al. | |
| 5,000,839 | A | * | 3/1991 | Kirker et al. | 208/89 |
| 5,219,814 | A | | 6/1993 | Kirker et al. | |
| 5,520,799 | A | | 5/1996 | Brown et al. | |
| 5,868,921 | A | | 2/1999 | Barre et al. | |
| 5,954,944 | A | * | 9/1999 | Zhang et al. | 208/89 |
| 6,299,759 | B1 | | 10/2001 | Bradway et al. | |
| 6,413,412 | B1 | * | 7/2002 | Peng et al. | 208/89 |
| 6,444,865 | B1 | | 9/2002 | Barre et al. | |
| 6,821,412 | B1 | | 11/2004 | Fujukawa et al. | |
| 7,005,057 | B1 | | 2/2006 | Kalnes | |
| 2002/0010086 | A1 | | 1/2002 | Plantenga et al. | |
| 2004/0004020 | A1 | * | 1/2004 | Grove et al. | 208/49 |
| 2005/0258073 | A1 | | 11/2005 | Oballa et al. | |

FOREIGN PATENT DOCUMENTS

| | | | |
|---|---|---|---|
| JP | 2007061679 | A | 3/2007 |
| WO | WO 96/09360 | | 3/1996 |
| WO | 2006069402 | A2 | 6/2006 |

* cited by examiner

METHOD OF MAKING HIGH ENERGY DISTILLATE FUELS

FIELD OF THE INVENTION

The present invention relates to a catalyst composition and to its use in hydroconversion processes, wherein a hydrocarbon oil comprising aromatic compounds is contacted with hydrogen in the presence of a catalyst composition. Specifically, the present invention is directed to a process for converting heavy hydrocarbon feedstreams to jet and diesel products using a single reactor, dual stage catalyst system; and using a single reactor, single stage catalyst system.

BACKGROUND OF THE INVENTION

Heavy hydrocarbon streams, such as FCC Light Cycle Oil ("LCO"), Medium Cycle Oil ("MCO"), and Heavy Cycle Oil ("HCO"), have a relatively low value. Typically, such hydrocarbon streams are upgraded through hydroconversion. Typically, such hydrocarbon streams are upgraded through hydroconversion.

Hydrotreating catalysts are well known in the art. Conventional hydrotreating catalysts comprise at least one Group VIII metal component and/or at least one Group VIB metal component supported on a refractory oxide support. The Group VIII metal component may either be based on a non-noble metal, such as nickel (Ni) and/or cobalt (Co), or may be based on a noble metal, such as platinum (pt) and/or palladium (Pd). Group VIB metal components include those based on molybdenum (Mo) and tungsten (W). The most commonly applied refractory oxide support materials are inorganic oxides such as silica, alumina and silica-alumina and aluminosilicates, such as modified zeolite Y. Examples of conventional hydrotreating catalyst are NiMo/alumina, CoMo/alumina, NiW/silica-alumina, Pt/silica-alumina, PtPd/silica-alumina, Pt/modified zeolite Y and PtPd/modified zeolite Y.

Hydrotreating catalysts are normally used in processes wherein a hydrocarbon oil feed is contacted with hydrogen to reduce its content of aromatic compounds, sulfur compounds, and/or nitrogen compounds. Typically, hydrotreating processes wherein reduction of the aromatics content is the main purpose are referred to as hydrogenation processes, while processes predominantly focusing on reducing sulfur and/or nitrogen content are referred to as hydrodesulfurization and hydrodenitrogenation, respectively.

The present invention is directed to a method of hydrotreating gas oil feedstocks with a catalyst in the presence of hydrogen and in a single stage reactor. Specifically, the method of the present invention is directed to a method of upgrading gas oil feedstock(s) to either jet and/or diesel products.

DESCRIPTION OF THE RELATED ART

Marmo, U.S. Pat. No. 4,162,961 discloses a cycle oil that is hydrogenated under conditions such that the product of the hydrogenation process can be fractionated.

Myers et al., U.S. Pat. No. 4,619,759 discloses the catalytic hydrotreatment of a mixture comprising a resid and a light cycle oil that is carried out in a multiple catalyst bed in which the portion of the catalyst bed with which the feedstock is first contacted contains a catalyst which comprises alumina, cobalt, and molybdenum and the second portion of the catalyst bed through which the feedstock is passed after passing through the first portion contains a catalyst comprising alumina to which molybdenum and nickel have been added.

Kirker et al., U.S. Pat. No. 5,219,814 discloses a moderate pressure hydrocracking process in which highly aromatic, substantially dealkylated feedstock is processed to high octane gasoline and low sulfur distillate by hydrocracking over a catalyst, preferably comprising ultrastable Y and Group VIII metal and a Group VI metal, in which the amount of the Group VIII metal content is incorporated at specified proportion into the framework aluminum content of the ultrastable Y component.

Kalnes, U.S. Pat. No. 7,005,057 discloses a catalytic hydrocracking process for the production of ultra low sulfur diesel wherein a hydrocarbonaceous feedstock is hydrocracked at elevated temperature and pressure to obtain conversion to diesel boiling range hydrocarbons.

Barre et al., U.S. Pat. No. 6,444,865 discloses a catalyst, which comprises from 0.1 to 15 wt % of noble metal selected from one or more of platinum, palladium, and iridium, from 2 to 40 wt % of manganese and/or rhenium supported on an acidic carrier, used in a process wherein a hydrocarbon feedstock comprising aromatic compounds is contacted with the catalyst at elevated temperature in the presence hydrogen.

Barre et al., U.S. Pat. No. 5,868,921 discloses a hydrocarbon distillate fraction that is hydrotreated in a single stage by passing the distillate fraction downwardly over a stacked bed of two hydrotreating catalysts.

Fujukawa et al., U.S. Pat. No. 6,821,412 discloses a catalyst for hydrotreatment of gas oil containing defined amounts of platinum, palladium and in support of an inorganic oxide containing a crystalline alumina having a crystallite diameter of 20 to 40 Å. Also disclosed id a method for hydrotreating gas oil containing an aromatic compound in the presence of the above catalyst at defined conditions.

Kirker et al., U.S. Pat. No. 4,968,402 discloses a one stage process for producing high octane gasoline from a highly aromatic hydrocarbon feedstock.

Brown et al., U.S. Pat. No. 5,520,799 discloses a process for upgrading distillate feeds. Hydroprocessing catalyst is placed in a reaction zone, which is usually a fixed bed reactor under reactive conditions and low aromatic diesel and jet fuel are produced.

SUMMARY OF THE INVENTION

In one embodiment, the present invention is directed to a process of upgrading a highly aromatic hydrocarbon feedstream comprising:

(a) contacting a highly aromatic hydrocarbon feedstream, wherein a major portion of the feedstream has a boiling range of from about 300° F. to about 800° F., under catalytic conditions with a catalyst system, containing a hydrotreating catalyst and a hydrogenation/hydrocracking catalyst in a single stage reactor system, wherein the active metals in the hydrogenation/hydrocracking catalyst comprises from about 5%-30% by weight of nickel and from about 5%-30% by weight tungsten; and (b) wherein at least a portion of said highly aromatic hydrocarbon feedstream is converted to a product stream having a boiling range within jet or diesel boiling ranges.

In another embodiment, the present invention is directed to a hydrocarbonaceous product prepared by a process comprising (a) contacting a highly aromatic hydrocarbon feedstream, wherein a major portion of the feedstream has a boiling range of from about 300° F. to about 800° F., under catalytic conditions with a catalyst system, containing a hydrotreating catalyst and a hydrogenation/hydrocracking catalyst in a single stage reactor system, wherein the active metals in the hydrogenation/hydrocracking catalyst comprises from about 5%-30% by weight of nickel and from about 5%-30% by weight tungsten; and (b) wherein at least a portion of said highly aromatic hydrocarbon feedstream is converted to a product stream having a boiling range within jet or diesel boiling ranges.

DETAILED DESCRIPTION OF THE INVENTION

While the invention is susceptible to various modifications and alternative forms, specific embodiments thereof are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

Definitions

FCC—refers to fluid catalytic crack -er, -ing, or -ed.

HDT—refers to "hydrotreater."

HDC—refers to "hydrocracker."

MUH2—refers to "makeup hydrogen."

Hydrogenation/hydrocracking catalyst may also be referred to as "hydrogenation catalyst" or "hydrocracking catalyst."

The terms "feed", "feedstock" or "feedstream" may be used interchangeably.

A. Overview

Figure 1:
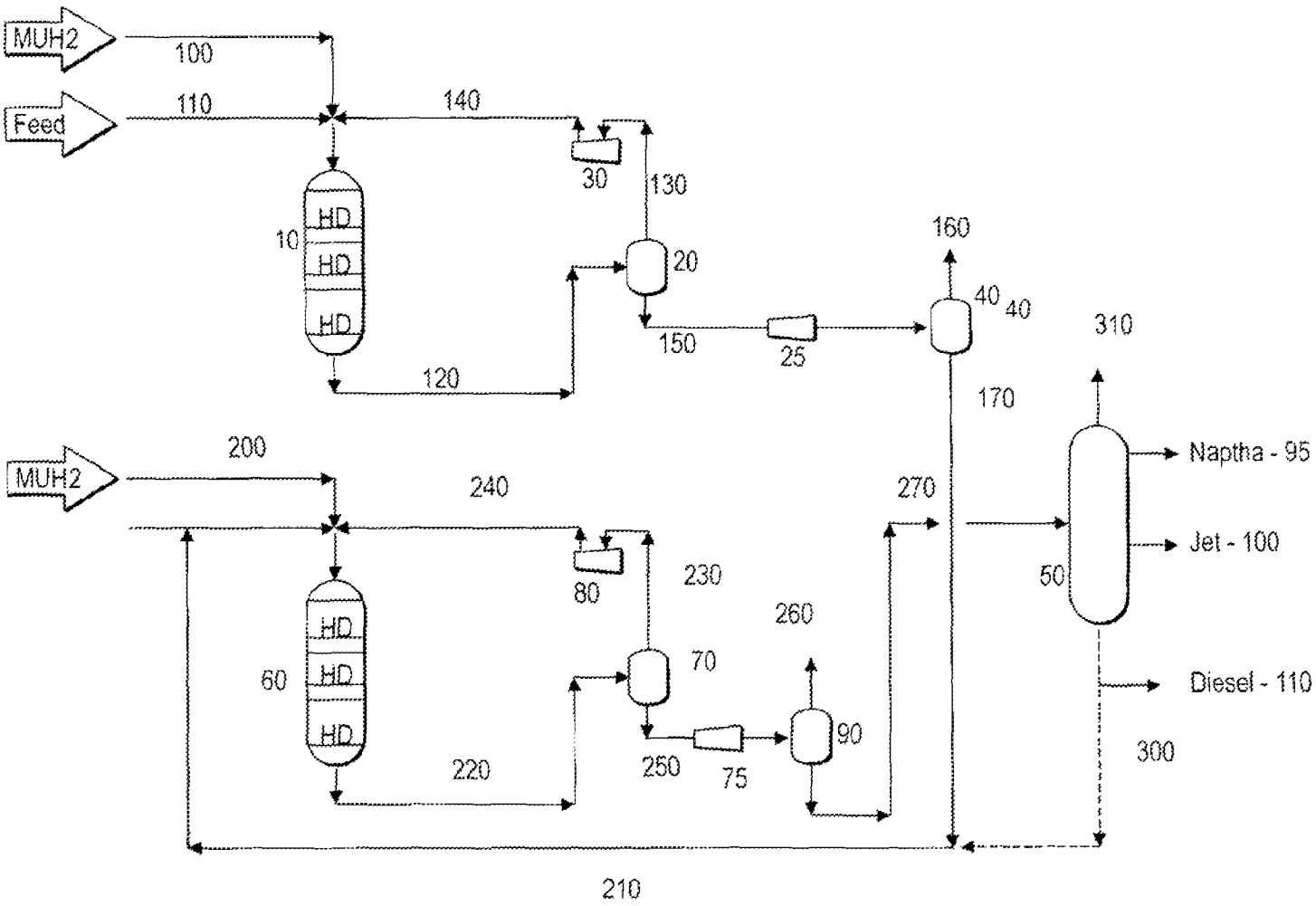
FIG. 1 (Prior Art)
FIG. 1 discloses a conventional two-stage process for producing naphtha, jet and diesel.

A known method of producing naphtha, jet and diesel is described generally with reference to FIG. 1. In the embodiment shown in FIG. 1, hydrocarbon gas oil 110 is fed to a hydrotreater 10 for sulfur/nitrogen removal. The hydrotreated product 120 is fed to the high pressure separator 20 where the reactor effluent is separated into a gas 130 and liquid stream 150. The product gas 130 is recompressed by the recycle gas compressor 30 to yield stream 140 which is then recycled into the reactor inlet where it is combined with the makeup hydrogen 100 and hydrocarbon gas oil feed 110. The liquid stream 150 is depressured at the liquid level control valve 25 and the product is separated into a gas stream 160 and into a liquid stream 170 in the low pressure separator 40.

The first stage liquid product 170 is fed into the second stage reactor 60 along with the second stage makeup hydrogen 200 and second stage recycle gas 240. The effluent 220 from the second stage reactor is fed into the second state high pressure separator 70 where the reactor effluent is separated into a gas 230 and into a liquid stream 250. The product gas 230 is recompressed by the recycle gas compressor 80 to yield stream 240 which is then recycled into the reactor inlet where it is combined with the makeup hydrogen 200 and hydrocarbon gas oil feed 210. The liquid stream 250 is depressured at the liquid level control valve 75 and the product is separated into a gas stream 260 and into a liquid stream 270 in the low pressure separator 90. The product stream 270 is fed to a distillation system 50 where the product 270 is separated to yield a gas stream 310, a naphtha product 95, and a high volumetric energy jet fuel 100 and diesel 110. Optionally, a portion f the diesel 300 can be recycled to the second stage reactor 60 to balance the jet/diesel product slate.

Figure 2:
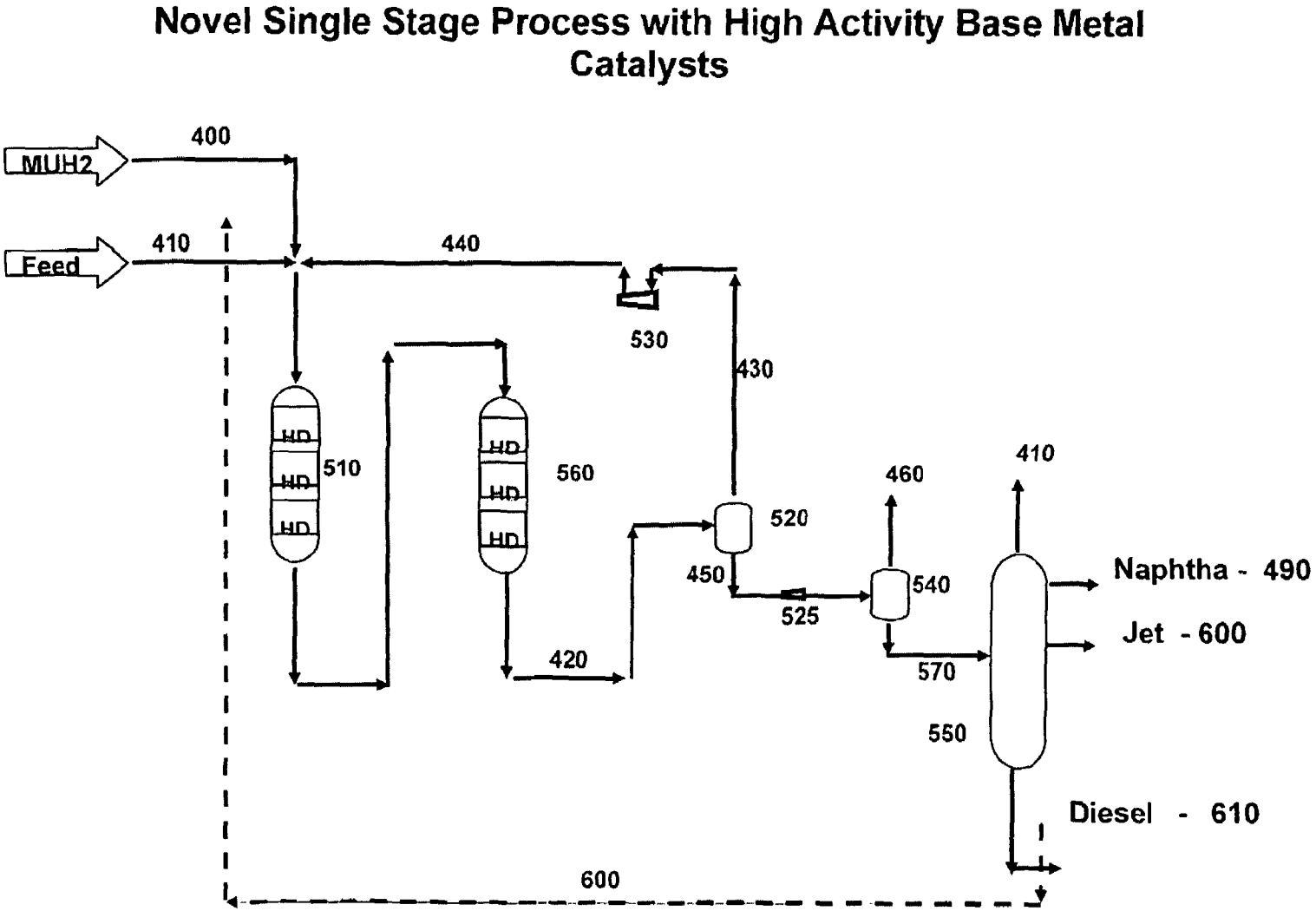
FIG. 2 discloses a single-stage process for producing high energy density naphtha, jet and diesel.

An embodiment of the present invention is described in FIG. 2. In the embodiment 20 shown in FIG. 2, hydrocarbon gas oil 410 is fed to a hydrotreater reactor 510 for sulfur/nitrogen removal and then directly to a hydrogenation/hydrocracking reactor 560. The hydrogenated/hydrocracked product 420 is fed to the high pressure separator 520 where the reactor effluent is separated into a gas 430 and liquid stream 450. The product gas 430 is recompressed by the recycle gas compressor 530 to yield stream 440 which is then recycled into the reactor inlet where it is combined with the makeup hydrogen 400 and hydrocarbon gas oil feed 410. The liquid stream 450 is depressured at the liquid level control valve 525 and the product is separated into a gas stream 460 and into a liquid stream 570 in the low pressure separator 540.

The liquid stream 570 is fed to a distillation system 550 where the liquid stream 570 is separated to yield a as stream 410, a naphtha product 490, and a high volumetric energy jet fuel 600 and diesel 610. Optionally, a portion of the diesel stream 610 can be recycled to the hydrotreater reactor 510 to balance the jet/diesel product slate.

B. Feed

Hydrocarbon gas oil may be upgraded to jet or diesel. The hydrocarbon gas oil feedstock is selected from FCC effluent, including an FCC light cycle oil, fractions of jet fuels, a coker product, coal liquefied oil, the product oil from the heavy oil thermal cracking process, the product oil from heavy oil hydrocracking, straight run cut from a crude unit, and mixtures thereof, and having a major portion of the feedstock having a boiling range of from about 250° F. to about 800° F., and preferably from about 350° F. to about 600° F. The term "major portion" as used in this specification and the appended claims, shall mean at least 50 wt. %.

Typically, the feedstock is highly aromatic and has up to about 80 wt % aromatics, up to 3 wt % sulfur and up to 1 wt % nitrogen. Preferably, the feedstock has an aromatic content of at least 40 wt % aromatics. Typically, the cetane number is about 25 units.

C. Catalysts

The catalyst system employed in the present invention comprises at least two catalyst layers consisting of a hydrotreating catalyst, a hydrogenation/hydrocracking catalyst, and a dewaxing catalyst. Optionally, the catalyst system may also comprise at least one layer of a demetallization catalyst and at least one layer of a second hydrotreating catalyst. The hydrotreating catalysts contains a hydrogenation component such as a metal from Group VIB and a metal from Group VIII, their oxides, their sulfide, and mixtures thereof and may contain an acidic component such as fluorine, small amounts of crystalline zeolite or amorphous silica alumina.

The hydrocracking catalysts contains a hydrogenation component such as a metal from Group VIB and a metal from Group VIII, their oxides, their sulfide, and mixtures thereof and contains an acidic component such as a crystalline zeolite or amorphous silica alumina.

One of the zeolites which is considered to be a good starting material for the manufacture of hydrocracking catalysts is the well-known synthetic zeolite Y as described in U.S. Pat. No. 3,130,007 issued Apr. 21, 1964. A number of modifications to this material have been reported one of which is ultrastable Y zeolite as described in U.S. Pat. No. 3,536,605 issued Oct. 27, 1970. To further enhance the utility of synthetic Y zeolite additional components can be added. For example, U.S. Pat. No. 3,835,027 issued on Sep. 10, 1974 to Ward et al. describes a hydrocracking catalysts containing at least one amorphous refractory oxide, a crystalline zeolitic aluminosilicate and a hydrogenation component selected from the Group VI and Group VIII metals and their sulfides and their oxides.

A hydrocracking catalyst which is a comulled zeolitic catalyst comprising about 17 weight percent alumina binder, about 12 weight percent molybdenum, about 4 weight percent nickel, about 30 weight percent Y-zeolite, and about 30 weight percent amorphous silica/alumina. This hydrocracking catalyst is generally described in U.S. patent application Ser. No. 870,011, filed by M. M. Habib et al. on Apr. 15, 1992 and now abandoned, the full disclosure of which is hereby incorporated by reference. This more general hydrocracking catalyst comprises a Y zeolite having a unit cell size greater than about 24.55 Angstroms and a crystal size less than about 2.8 microns together with an amorphous cracking component, a binder, and at least one hydrogenation component selected from the group consisting of a Group VI metal and/or Group VIII metal and mixtures thereof.

In preparing a Y zeolite for use in accordance with the invention herein, the process as disclosed in U.S. Pat. No. 3,808,326 should be followed to produce a Y zeolite having a crystal size less than about 2.8 microns.

More specifically, the hydrocracking catalyst suitably comprises from about 30%-90% by weight of Y zeolite and amorphous cracking component, and from about 70%-10% by weight of binder. Preferably, the catalyst comprises rather high amounts of Y zeolite and amorphous cracking component, that is, from about 60%-90% by weight of Y zeolite and amorphous cracking component, and from about 40%-10% by weight of binder, and being particularly preferred from about 80%-85% by weight of Y zeolite and amorphous cracking component, and from about 20%-15% by weight of binder. Preference is given to the use of silica-alumina as the amorphous cracking component.

The amount of Y zeolite in the catalyst ranges from about 5-70% by weight of the combined amount of zeolite and cracking component. Preferably, the amount of Y zeolite in the catalyst compositions ranges from about 10%-60% by weight of the combined amount of zeolite and cracking component, and most preferably the amount of Y zeolite in the catalyst compositions ranges from about 15-40% by weight of the combined amount of zeolite and cracking component.

Depending on the desired unit cell size, the $SiO_2/Al_2O_3$ molar ratio of the Y zeolite may have to be adjusted. There are many techniques described in the art which can be applied to adjust the unit cell size accordingly. It has been found that Y zeolites having a $SiO_2/Al_2O_3$ molar ratio of from about 3 to about 30 can be suitably applied as the zeolite component of the catalyst compositions according to the present invention. Preference is given to Y zeolites having a molar $SiO_2/Al_2O_3$ ratio from about 4 to about 12, and most preferably having a molar $SiO_2/Al_2O_3$ ratio from about 5 to about 8.

The amount of cracking component such as silica-alumina in the hydrocracking catalyst ranges from about 10%-50% by weight, preferably from about 25%-35% by weight. The amount of silica in the silica-alumina ranges from about 10%-70% by weight. Preferably, the amount of silica in the silica-alumina ranges from about 20%-60% by weight, and most preferably the amount of silica in the silica-alumina ranges from about 25%-50% by weight. Also, so-called X-ray amorphous zeolites (i.e., zeolites having crystallite sizes too small to be detected by standard X-ray techniques) can be suitably applied as cracking components according to the process embodiment of the present invention. The catalyst may also contain fluorine at a level of from about 0.0 wt % to about 2.0 wt %.

The binder(s) present in the hydrocracking catalyst suitably comprise inorganic oxides. Both amorphous and crystalline binders can be applied. Examples of suitable binders comprise silica, alumina, clays and zirconia. Preference is given to the use of alumina as binder.

The amount(s) of hydrogenation component(s) in the catalyst suitably range from about 0.5% to about 30% by weight of Group VIII metal component(s) and from about 0.5% to about 30% by weight of Group VI metal component(s), calculated as metal(s) per 100 parts by weight of total catalyst. The hydrogenation components in the catalyst may be in the oxidic and/or the sulphidic form. If a combination of at least a Group VI and a Group VIII metal component is present as (mixed) oxides, it will be subjected to a sulphiding treatment prior to proper use in hydrocracking.

Suitably, the catalyst comprises one or more components of nickel and/or cobalt and one or more components of molybdenum and/or tungsten or one or more components of platinum and/or palladium.

The hydrotreating catalyst comprises from about 2%-20% by weight of nickel and from about 5%-20% by weight molybdenum. Preferably the catalyst comprises 3%-10% nickel and from about 5%-20 molybdenum. More preferred, the catalyst comprises from about 5%-10% by weight of nickel and from about 10%-15% by weight molybdenum, calculated as metals per 100 parts by weight of total catalyst. Even more preferred, the catalyst comprises from about 5%-8% nickel and from about 8% to about 15% nickel. The total weight percent of metals employed in the hydrotreating catalyst is at least 15 wt %.

In one embodiment, the ratio of the nickel catalyst to the molybdenum catalyst is no greater than about 1:1.

The active metals in the hydrogenation/hydrocracking catalyst comprise nickel and at least one or more VI B metal. Preferably, the hydrogenation/hydrocracking catalyst comprises nickel and tungsten or nickel and molybdenum. Typically, the active metals in the hydrogenation/hydrocracking catalyst comprise from about 3%-30% by weight of nickel and from about 2%-30% by weight tungsten, calculated as metals per 100 parts by weight of total catalyst. Preferably, the active metals in the hydrogenation/hydrocracking catalyst comprise from about 5%-20% by weight of nickel and from about 5%-20% by weight tungsten. More preferred, the active metals in the hydrogenation/hydrocracking catalyst comprise from about 7%-15% by weight of nickel and from about 8%-15% by weight tungsten. Most preferred, the active metals in the hydrogenation/hydrocracking catalyst comprise from about 9%-15% by weight of nickel and from about 8%-13% by weight tungsten. The total weight percent of the metals is from about 25 wt % to about 40 wt %.

Optionally, the acidity of the hydrogenation/hydrocracking catalyst may be enhanced by adding at least 1 wt % fluoride, preferably from about 1-2 wt % fluoride.

In another embodiment, the hydrogenation/hydrocracking catalyst may be replaced by a similarly high activity base metal catalyst where the support is an amorphous alumina or silica or both and where the acidity has been enhanced by a zeolite, such as H-Y in a concentration of from about 0.5 wt % to about 15 wt %.

The effective diameter of the hydrotreating catalyst particles was about 0.1 inch, and the effective diameter of the hydrocracking catalyst particles was also about 0.1 inch. The two catalysts are intermixed in a weight ratio of about 1.5:1 hydrotreating to hydrocracking catalyst.

In one embodiment, a dewaxing catalyst may be employed when the freeze point of the product is greater than from about −40° C. to about 0° C. (i.e., the feedstock has a n-paraffin content of greater than about 5 wt %). When the feedstock contains greater than 5 wt % n-paraffins, then the product may have an undesirable cloud point. In order to obtain a product with a more acceptable cloud point, a dewaxing catalyst may be added to the hydrogenation/hydrocracking section of the reactor system. The dewaxing catalyst may comprise SAPO 11, SM-3, ZSM-5 or SZ-32 catalyst. The dewaxing catalyst is added to the hydrogenation/hydrocracking section of the reactor system. Preferably, the amount of the dewaxing catalyst added shall not exceed 30 wt % of the total catalyst load in the hydrogenation/hydrocracking section. More preferred, the dewaxing catalyst comprises from about 1 to 20 wt % of the total catalyst load in the hydrogenation/hydrocracking section. Most preferred, the dewaxing catalyst comprises from about 1 to 10 wt % of the total catalyst load in the hydrogenation/hydrocracking section.

The dewaxing catalyst, ZSM-5 crystalline aluminosilicate zeolite, which is employed in an embodiment of the present invention, is known for its catalytic acitivity for use in upgrading hydrocarbon and hydrocarbon-forming feeds. This zeolite and its preparation are described in U.S. Pat. No. 3,702,886 (R. J. Argauer et al) and U.S. Pat. No. 3,770,614 (R. G. Graven), which are incorporated herein by reference, as well as in many other patent literature references. It is useful in numerous processes for upgrading hydrocarbon and hydrocarbon-forming feeds, for example in hydrocracking, isomerizing, alkylating, forming aromatic hydrocarbons, selective hydrocracking, disproportionating alkyl-substituted benzenes, dewaxing lube oil stocks, and the like hydrocarbon reactions in the presence or absence of added hydrogen gas. In its use, especially at elevated process temperatures, and like many other hydrocarbon processing catalysts, carbonaceous by-product material is deposited on and/or in its surfaces and pores. As this deposit increases, the activity and/or effectivity of the catalyst for the desired upgrading diminishes. When this activity or effectivity reaches an undesirably low level, the process is interrupted, the catalyst is regenerated by a controlled burning of the deposit, and the process is continued. The time required for the regeneration step is, of course, non-productive in terms of the desired processing, that is, the on-stream period of the process cycle. There is a need to substantially increase the on-stream or operating time in a process using a ZSM-5 zeolite catalyst. A method for the preparation of ZSM-5 zeolites is described in the patents cited above. However, for those having rather high silica-to-alumina mol ratios, for example above 50, it is necessary that the mol ratio of the precursors of silica to alumina in the reaction mixture substantially exceed that of the desired zeolite. Depending upon the reactants, and conditions used in the preparation, this excess of silica precursor in the reaction mixture may range from a minor amount up to a one- or two-fold excess or higher. However, by standardizing the reactants and conditions and routinely carrying out several trial runs using different ratios of the precursors, the ratio of these reactants required to produce a ZSM-5 zeolite having a desired silica-to-alumina mol ratio is readily determined.

The ZSM-5 zeolite is normally prepared in its sodium form, and in this form it has little or none of the desired catalytic activity. By conventional base- and/or ion-exchange methods routinely employed in the zeolite art, the ZSM-5 zeolite is converted to its H-form, including customary drying and calcining steps. The H-ZSM-5 zeolites herein desirably having residual sodium contents below 1 weight percent, preferably less than about 100 ppm. In addition to and/or in lieu of hydrogen, the cation sites of the zeolite may also be satisfied by catalytic ions such as copper, zinc, silver, rare earths, and Group V, VI, VII and VIII metal ions normally used in hydrocarbon processing. The H-ZSM-5 and Zn-H-ZSM-5 forms of the zeolite are preferred.

The ZSM-5 catalyst may be in any convenient form, that is, as required for ordinary fixed-bed, fluid-bed or slurry use. Preferably it is used in a fixed-bed reactor and in a composite with a porous inorganic binder or matrix in such proportions that the resulting product contains from 1% to 95% by weight, and preferably from 10% to 70% by weight, of the zeolite in the final composite.

The term "porous matrix" includes inorganic compositions with which a zeolite can be combined, dispersed, or otherwise intimately admixed wherein the matrix may or may not be catalytically active. The porosity of the matrix can either be inherent in the particular material or it can be caused by mechanical or chemical means. Representative of satisfactory matrices include pumice, firebrick, diatomaceous earths, and inorganic oxides. Representative inorganic oxides include alumina, silica, amorphous silica-alumina mixtures, naturally occurring and conventionally processed clays, for example bentonite, kaolin and the like, as well as other siliceous oxide mixtures such as silia-magnesia, silica-zirconia, silica-titania and the like. The compositing of the zeolite with an inorganic oxide matrix can be achieved by any suitable known method wherein the zeolite is intimately admixed with the oxide while the latter is in a hydrous state, for example as a hydrosol, hydrogel, wet gelatinous preciptate, or in a dried state or combinations thereof. A convenient method is to prepare a hydrous mono or plural oxide gel or cogel using an aqueous solution of a salt or mixture of salts, for example aluminum sulfate, sodium silicate and the like. To this solution is added ammonium hydroxide, carbonate, etc., in an amount sufficient to precipitate the oxides in hydrous form. After washing the precipitate to remove at least most of any water-soluble salt present in the precipitate, the zeolite in finely divided state is thoroughly admixed with the precipitate together with added water or lubricating agent sufficient in amount to facilitate shaping of the mix as by extrusion.

In addition to the matrix and ZSM-5 zeolite, the catalyst may contain a hydrogenation/dehydrogenation component which may be present in an amount varying from 0.01 to 30 weight percent of the total catalyst. A variety of hydrogenation components may be combined with either the ZSM-5 zeolite and/or the matrix in any feasible known manner affording intimate contact of the components, including base exchange, impregnation, coprecipitation, cogellation, mechanical admixture, and the like methods. The hydrogenation component can include metals, oxides and sulfides of metals of Groups VI-B, VII and VIII of the Periodic Chart of the Elements. Representative of such components include molybdenum, tungsten, manganese, rhenium, cobalt, nickel, platinum, palladium and the like and combinations thereof.

Optionally, a demetallization catalyst may be employed in the catalyst system. Typically, the demetallization catalyst comprises Group VIB and Group VIII metals on a large pore alumina support. The metals may comprise nickel, molybdenum and the like on a large pore alumina support. Preferably, at least about 2 wt % nickel is employed and at least about 6 wt % molybdenum is employed. The demetallization catalyst may be promoted with at least about 1 wt % phosphorous.

Optionally, a second hydrotreating catalyst may also be employed in the catalyst system. The second hydrotreating catalyst comprises the same hydrotreating catalyst as described herein.

D. Products

The method employed in the present invention upgrades heavy hydrocarbon feedstreams to either jet and/or diesel products. The products of the present process include jet and diesel fuels having a high energy density. Typically the product streams have aromatic saturation (i.e., low aromatic content) greater than or equal to 70 wt %. The product also has an energy density that is greater than 120,000 Btu/gal, preferably greater than 125,000 Btu/gal. The jet fuel product has a smoke point of greater than 20 mm. The jet fuel product also has a freeze point of less than −40 degrees C. Preferably, the freeze point is less than −50 degrees C. The diesel product has a cetane index of at least 40.

E. Process Conditions

One embodiment of the present invention is a method of making a high energy distillate fuel, preferably having a boiling range in the jet and/or diesel boiling ranges. This method comprises contacting the heavy, highly aromatic hydrocarbonaceous feed, as described herein, with a catalyst system which consists of a hydrotreating catalyst and a hydrocracking catalyst. The reaction system operates as a single stage reaction process under essentially the same pressure and recycle gas flowrate. The reaction system has two sections: a hydrotreating section and a hydrocracking section, which are located in series. There is a pressure differential between the hydrotreating section and the hydrocracking section caused by pressure drop due to flow through the catalyst. The pressure differential is no more than about 200 psi. More preferred the pressure differential is no more than 100 psi. Most preferred the pressure differential is no more than 50 psi.

Representative feedstocks include highly aromatic refinery streams such as fluid catalytic cracking cycle oils, thermally cracked distillates, and straight run distillates, which come from the crude unit. These feedstocks generally have a boiling-range above about 200° F. and generally have a boiling range between 350° F. and about 750° F.

The hydrocarbonaceous feedstock is contacted with hydrogen in the presence of the catalyst system under upgrading conditions which generally include a temperature in the range of from about 550° F. to about 775° F., preferably from about 650° F. to about 750° F., and most preferred from about 700° F. to about 725° F.; a pressure of from about 750 pounds per square inch absolute (psia) to about 3,500 psia, preferably from about 1,000 psia to about 2,500 psia, and most preferred from about 1250 psia to about 2000 psia; and a liquid hourly space velocity (LHSV) of from about 0.2 to about 5.0, preferably from about 0.5 to about 2.0, and most preferred from about 0.8 to about 1.5; and an oil to gas ratio of from about 1,000 standard cubic feet per barrel (scf/bbl) to about 15,000 scf/bbl, preferably from about 4,000 scf/bbl to about 12,000 scf/bbl, and most preferred from about 6,000 scf/bbl to about 10,000 scf/bbl.

F. Process Equipment

The catalyst system of the present invention can be used in a variety of configurations. In the present invention, however, the catalyst is used in a single stage reaction system. Preferably, a reaction system contains a hydrotreater and a hydrocracker reactor operating in the same recycle gas loop and at essentially the same pressure. For example, the highly aromatic feed is introduced to the high pressure reaction system, which contains the hydrotreating and hydrocracking catalysts. The feed is combined with recycled hydrogen and introduced to the reaction system which comprises a first section containing a hydrotreating catalyst and a second section containing a hydrocracking catalyst. The first section comprises at least one reaction bed containing a hydrotreating catalyst. The second section comprises at least one reaction bed containing a hydrocracking catalyst. Both sections are operating at the same pressure. Under reaction conditions, the highly aromatic feed is saturated to extremely high levels therein producing a highly saturated product. The effluent from the reaction system is a highly saturated product having a boiling range in the jet and diesel ranges. After the reaction has taken place, the reaction product is fed to a separation unit (i.e., distillation column and the like) in order to separate the high energy density jet, the high energy density diesel, naptha and other products. Un-reacted product may be recycled to the reaction system for further processing to maximize jet or diesel production.

Other embodiments will be obvious to those skilled in the art.

The following examples are presented to illustrate specific embodiments of this invention and are not to be construed in any way as limiting the scope of the invention.

Examples

Table 1 shows a fuel product which required further hydrogenation to meet the specification for aromatic content. Optionally, the diesel fuel product could be further distilled to adjust the viscosity and/or flash point.

Furthermore, as seen in the Examples, employing a dewaxing catalyst in the hydrogenation/hydrocracking reactor, lowers the cloud point to a temperature that avoids filter plugging and brings the fuel product back into specification range for cloud point.

The fuel product was prepared by the following process:

In general a feedstream, having a boiling range of about 300 degrees F. to 600 degrees F. was fed to a single stage reactor, which comprised a catalyst system, having a liquid hourly space velocity (LHSV) of 1.0 l/Hr. A catalyst system was employed to produce the product. This catalyst system comprised layers of a demetallization catalyst, a hydrotreating catalyst, a hydrogenation/hydrocracking catalyst, and a dewaxing catalyst. The demetallization catalyst comprised Group VI and Group VIII metals, specifically 2 wt % nickel and 6 wt % molybdenum, on a large pore support. The catalyst was promoted with phosphorus. The hydrotreating catalyst consisted of a Group VI and Group VIII metals catalysts, which was promoted with phosphorus, on a large surface area alumina, non-acidic support. The total metals were 20 wt %. The hydrogenation/hydrocracking catalyst was a high activity base metal catalyst consisting of 20 wt % nickel/20 wt % tungsten over a large area amorphous silica alumina, where the acidity was enhanced by adding 2 wt % fluoride as hydrofluoric acid. The dewaxing catalyst was a ZSM-5 crystalline aluminosilicate zeolite. The temperature of the reactor was about 470° F. Hydrogen, having a pressure of 1200 p.s.i.g, was fed to the reactor at a rate of about 450 scf/bbl.

| Case: | Comparative Example A | 1 | 2 |
|---|---|---|---|
| Run Hours: | 3732 | 3804 | 4020 |
| Operating Conditions: | | | |
| Pressure, psig | | 1200 | |
| LHSV, 1/Hr | | 3.0 (ICR406)/3.0 (ICR407) | |
| CAT, ° F. | | | |
| Dewaxing Catalyst (ZSM-5) | 150 | 450 | 500 |
| Hydrofinishing Catalyst | 468 | 470 | 470 |
| H2 Consumption, SCFB | 450 | 470 | 440 |
| Yield, Vol. % | | | |
| Total Fuel | | | |
| Naphtha | 49.8 | 50.3 | 48.8 |
| Jet Fuel | 50.0 | 49.4 | 50.9 |

-continued

| Case: | Comparative Example A | 1 | 2 |
|---|---|---|---|
| Inspections: | | | |
| Jet Fuel | AB | AC | AD |
| API Gravity | 53.5 | 53.4 | 53.4 |
| Oxygen, % | <0.1 | <0.1 | <0.1 |
| Aromatics by UV | | | |
| UV @ 272 nm | 0.0163 | 0.0153 | |
| UV @ 310 nm | 0.0010 | 0.0013 | |
| Bromine Number | 0.14 | 0.48 | |
| Cloud Point, C. | 1 | −7 | −9 |
| Freeze Point, C. | — | — | −1 |
| Distillation, D2887 | | | |
| 10/30% | 383/420 | 383/420 | 387/423 |
| 50% | 452 | 453 | 457 |
| 70/90% | 478/523 | 486/536 | 489/547 |
| Characterization Factor | 12.71 | 12.70 | 12.72 |
| Naphtha: | E | F | G |
| API Gravity | 63.2 | 63.3 | 63.3 |
| Aromatics by UV | | | |
| UV @ 272 nm | 0.0163 | 0.0084 | |
| UV @ 310 nm | 0.0002 | 0.0002 | |
| Bromine Number | 0.12 | 0.38 | |
| Freeze Point, C. | −61 | −55 | −53 |
| Distillation, D2887 | | | |
| 10/30% | 211/263 | 207/259 | 247/303 |
| 50% | 306 | 302 | 308 |
| 70/90% | 346/373 | 343/380 | 348/385 |
| Characterization Factor | 12.62 | 12.60 | 12.63 |

More specifically, in one example, a highly paraffinic feedstream was fed over a layer of a dewaxing catalyst and then was fed over a layer of a hydrofinishing catalyst. The feedstream consisted of approximately 50% jet and 50% non-jet components. Comparative Example A shows jet and non-jet products which resulted from the hydrogenation and distillation of the feedstream. The process employed in Comparative Example A did not employ a dewaxing catalyst in the reactor bed. By contrast, Examples 1 and 2 are the result of employing a dewaxing catalyst along with hydrogenation catalyst in the reactor bed. As evidenced, the cloud point is lowered when a dewaxing catalyst is employed. See Table above.

What is claimed is:

1. A process of upgrading a highly aromatic hydrocarbon feedstream to a product stream having a boiling range within a jet boiling range, the process comprising:

(a) contacting a highly aromatic hydrocarbon feedstream, having a normal paraffin content of greater than at least about 5 wt %, wherein a major portion of the feedstream has a boiling range of from about 300° F. to about 800° F. and wherein the feedstream has an aromatic content of at least 40 wt % and a sulfur content up to 3 wt %, under catalytic conditions with a catalyst system, containing a hydrotreating catalyst, a hydrogenation/hydrocracking catalyst, and non-Group VIB or Group VIII metal hydrogenation component-containing zeolitic dewaxing catalyst in a single stage reactor system, wherein the active metals in the hydrogenation/hydrocracking catalyst comprises from about 20%-30% by weight of nickel and from about 5%-30% by weight tungsten; wherein the single stage reactor system comprises a hydrotreating section and a hydrocracking section and further wherein the hydrocracking section comprises the hydrocracking catalyst and the dewaxing catalyst, wherein the dewaxing catalyst is layered with the hydrocracking catalyst or the dewaxing catalyst is blended with the hydrocracking catalyst; and (b) wherein at least a portion of said highly aromatic hydrocarbon feedstream is converted to the product stream having a boiling range within the jet boiling range, and further wherein the product stream has a net heat of combustion of greater than 125.000 Btu/gal and an aromatic saturation that is greater than 70 wt. %.

2. The process according to claim 1 wherein the active metals in the hydrogenation/hydrocracking catalyst consists essentially of from about 20%-30% by weight of nickel and from about 5%-30% by weight tungsten.

3. The process according to claim 1 wherein the hydrocracking section comprises no more than 30 wt of the dewaxing catalyst.

4. The process according to claim 1 wherein the hydrocracking section comprises at least one reactor bed.

5. The process according to claim 1 wherein the product stream is separated into a jet fuel product.

6. The process according to claim 1 wherein said major portion of the feedstream has a boiling range of from about 300° F. to about 600° F.

7. The process according to claim 1, wherein the feedstream has an aromatic content of at least 40 wt % up to about 80 wt %.

8. The process according to claim 1 wherein the zeolitic dewaxing catalyst is a crystalline aluminosilicate zeolite dewaxing catalyst.

9. The process according to claim 8 wherein the crystalline aluminosilicate zeolite dewaxing catalyst is ZSM-5.

* * * * *